US007719385B2

(12) United States Patent
Choi et al.

(10) Patent No.: US 7,719,385 B2
(45) Date of Patent: May 18, 2010

(54) METHOD AND DIVIDER FOR DIVIDING POWER FOR ARRAY ANTENNA AND ANTENNA DEVICE USING THE DIVIDER

(75) Inventors: Jong-In Choi, Seoul (KR); Young-Jai Kim, Seoul (KR); Dae-Sung Kim, Seoul (KR); Yu-Rin Kim, Kyounggi-do (KR)

(73) Assignee: Sunwoo Communication Co., Ltd (KR)

( * ) Notice: Subject to any disclaimer, the term of this patent is extended or adjusted under 35 U.S.C. 154(b) by 0 days.

(21) Appl. No.: 11/890,588

(22) Filed: Aug. 7, 2007

(65) Prior Publication Data

US 2008/0136553 A1 Jun. 12, 2008

(30) Foreign Application Priority Data

Sep. 28, 2006 (KR) ..... 10-2006-0095148
Sep. 28, 2006 (KR) ..... 10-2006-0095149

(51) Int. Cl.
*H01P 5/12* (2006.01)

(52) U.S. Cl. ..... 333/136; 333/126; 333/128; 333/134

(58) Field of Classification Search ..... 333/125–129, 333/134, 136

See application file for complete search history.

(56) References Cited

U.S. PATENT DOCUMENTS 3,525,995 A * 8/1970 Schroeder ..... 343/777
3,887,925 A * 6/1975 Ranghelli et al. ..... 343/795
5,202,698 A * 4/1993 Jelloul ..... 343/770
5,708,446 A * 1/1998 Laramie ..... 343/815
6,061,025 A 5/2000 Jackson
6,064,862 A 5/2000 Grenon et al.
6,175,723 B1 1/2001 Rothwell
6,198,438 B1 3/2001 Herd
6,377,217 B1 4/2002 Zhu
6,441,787 B1 8/2002 Richards
6,501,427 B1 12/2002 Lilly
6,538,603 B1 * 3/2003 Chen et al. ..... 342/372

FOREIGN PATENT DOCUMENTS

JP 04-310002 11/1992
JP 2000-114851 4/2000
KR 1020030039928 A 5/2003
KR 1020050094660 A 9/2005

* cited by examiner

*Primary Examiner*—Robert Pascal
*Assistant Examiner*—Kimberly E Glenn
(74) *Attorney, Agent, or Firm*—Robert C. Klinger

(57) ABSTRACT

Disclosed herein are a method and divider for dividing power between and supplying the parts of the power to respective radiation elements of an array antenna, and an antenna device using the divider. The division method includes the steps of dividing power, applied to a feeding unit, into two parts at a first stage of division, and supplying a first of the two parts to at least one central radiation element, and dividing a second of the two parts and supplying sub-parts of the second part to respective peripheral radiation elements, thereby supplying relatively high power to the central radiation element and relatively low power to the peripheral radiation elements.

2 Claims, 9 Drawing Sheets

METHOD AND DIVIDER FOR DIVIDING POWER FOR ARRAY ANTENNA AND ANTENNA DEVICE USING THE DIVIDER

BACKGROUND OF THE INVENTION

1. Field of the Invention

The present invention relates generally to a Radio Frequency (RF) repeater array antenna and, more particularly, to a method and divider for efficiently dividing power between respective radiation elements of an array antenna.

2. Description of the Related Art

An RF repeater antenna generally includes a radiation element array for transmitting and receiving radio waves, a reflector disposed behind the radiation element array and configured to reflect radio waves, and a division circuit for equally dividing power and providing equally divided power to respective radiation elements. According to the typical characteristics of an antenna, the antenna has non-uniform radio wave intensity at the locations of respective radiation elements, and exhibits a radiation pattern that has developed back and side lobes due to the scattering of radio waves at the edge of a reflector and the like.

Due to the above-described phenomena, signal interference occurs between transmission and reception signals or between repeaters. Schemes for improving the Front to Back (F/B) and Front to Side (F/S) ratios of an antenna by suppressing undesired waves that generate back and side lobes have been proposed.

For example, the above-described schemes include a scheme using a multi-reflecting plate structure and a radio wave absorption body, and a scheme based on the arrangement of radiation elements and the adjustment of the intervals between elements. However, the first scheme has problems in that the scale, size, and weight of the entire antenna are increased and in that an auxiliary side lobe is generated in front of an antenna, so that it is difficult to realize an F/S ratio equal to or higher than 20 dB. Meanwhile, the second scheme has a problem in that the design of the arrangement of radiation elements, the design of the intervals between the radiation elements, and means for adjusting a radiation pattern are complicated, so that the design and implementation thereof are difficult.

As known from theory, an F/B ratio and an F/S ratio can be improved by relatively increasing power for the center patch of an array and relatively decreasing power for the side patch of the array. Meanwhile, in order to feed a large amount of power to the center of the array using a typical parallel feeding method, a low division rate is required, so that the width of a division pattern must be designed so that it is very small. For example, in the case where, in a typical 3×3 patch array shown in FIG. 1, 1:8 power division is performed for a dielectric substrate having a dielectric constant of 3.0 and a thickness of 0.8t, a pattern having a width equal to or less than 0.2 mm is required. For this reason, problems arise in that it is difficult to implement such a scheme and it is difficult to use the increased normal transfer capability of an antenna.

SUMMARY OF THE INVENTION

Accordingly, the present invention has been made keeping in mind the above problems occurring in the prior art, and an object of the present invention is to provide an improved method of dividing power, and a divider using the method so as to improve the F/B and F/S ratio characteristics of an array antenna.

Another object of the present invention is to provide an array antenna device to which the divider is applied.

In order to accomplish the above object, the present invention provides a method of dividing power between and supplying divided power to respective radiation elements of an array antenna, including the steps of dividing power, applied to a feeding unit, into two parts at a first stage of division, and supplying a first of the two parts to at least one central radiation element, and dividing a second of the two parts and supplying sub-parts of the second part to respective peripheral radiation elements, thereby supplying relatively high power to the central radiation element and relatively low power to the peripheral radiation elements. The division method is implemented on a dielectric feeding substrate, thereby forming a divider according to the present invention. The divider constitutes an antenna device according to the present invention, along with an array substrate and a reflector.

The present invention has as its foundation the idea that, in order to improve the F/B and F/S characteristics of an array antenna, the power of a central patch must be enhanced and the power of peripheral patches must be weakened. According to the present invention, advantages arise in that the characteristics of an antenna are improved and the design and implementation of the antenna are easily achieved. The features and effects of the present invention will be apparent from the detailed description of embodiments that will be given in conjunction with the accompanying drawings.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
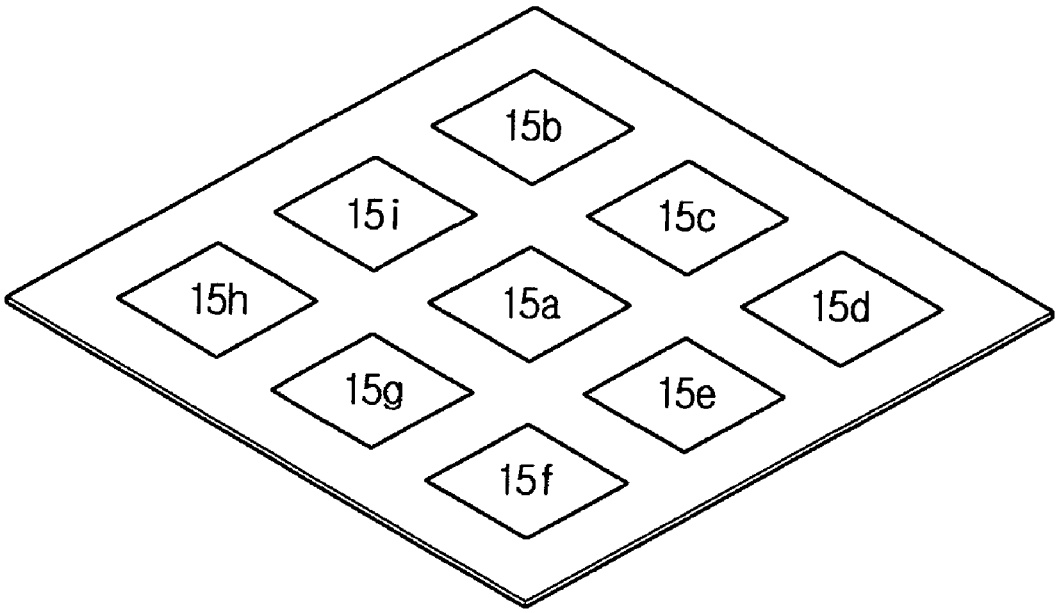
FIG. 1 Prior Art
FIG. 1 is a perspective view of a typical radiation element array.

Reference now should be made to the drawings, in which the same reference numerals are used throughout the different drawings to designate the same or similar components.

Figure 2:
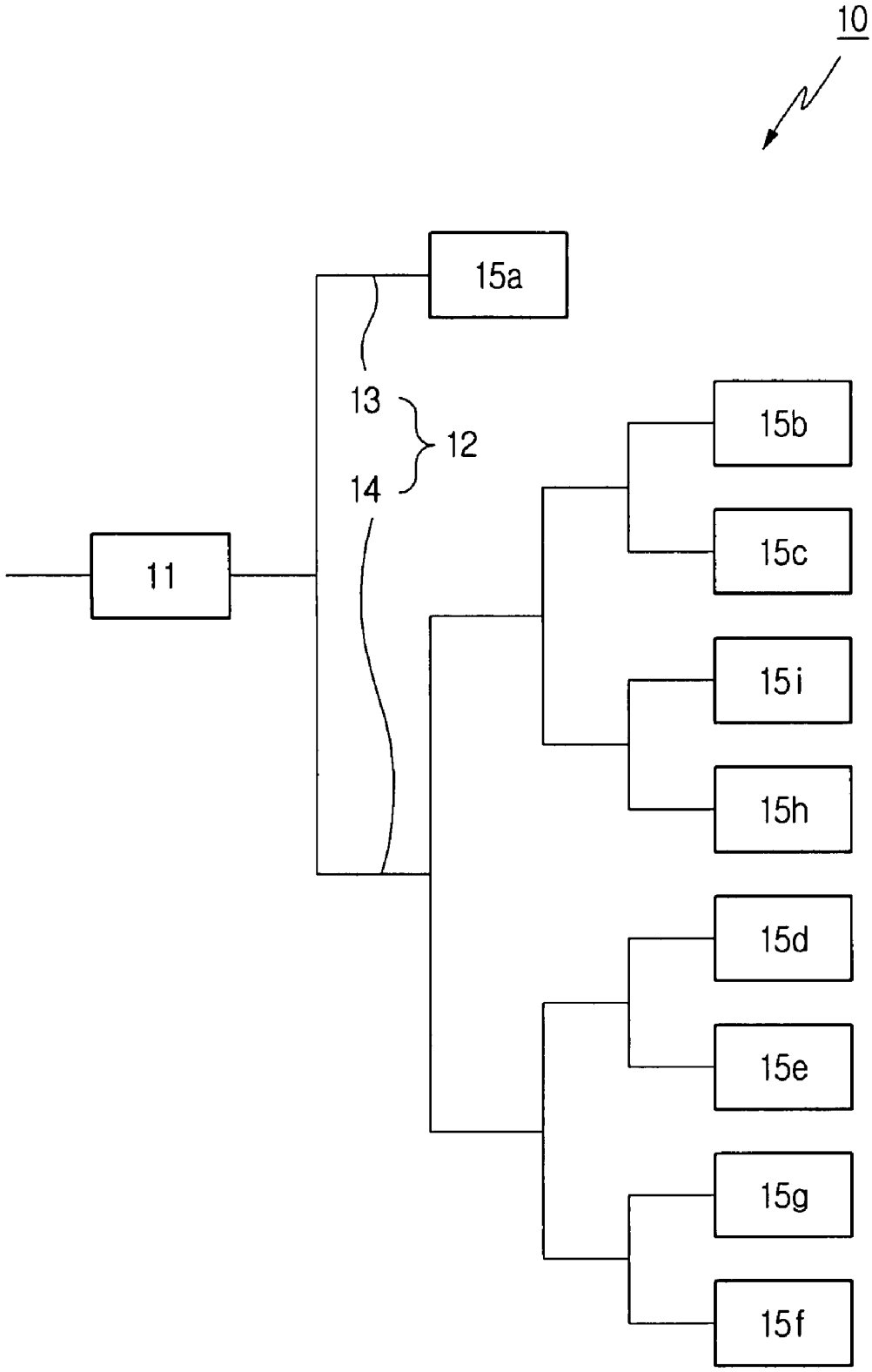
FIG. 2 is a schematic circuit diagram illustrating a method of dividing power according to the present invention.

FIG. 2 is a schematic diagram of a division circuit 10 for dividing power between radiation elements 15*a*-15*i*, arranged in a 3×3 array as shown in FIG. 1, according to the present invention. The division circuit 10 includes a single feeding unit 11 connected to a feeding connector, and a feeding line 12 connected from the feeding unit 11 to respective radiation element 15*a*-15*i* arranged on an array substrate. The feeding line 12 is branched into a first branch line 13 and a second branch line 14 at the first stage of the feeding unit 11. Of the first and second branch lines 13 and 14, the first branch line 13 is connected to a central radiation element 15*a*, and the second branch line 14 is branched again and connected to peripheral radiation elements 15*b*-15*i*.

As a result, according to the present invention, the division of power is performed in such a manner that the power applied to the feeding unit 11 is divided into two parts at the first stage of division, one of the parts is supplied to the central radiation element 15*a*, and the other part is divided again and supplied to the peripheral radiation elements 15*b*-15*i*. For the shown 3×3 array, power is supplied in series to the central radiation element 15*a*, and is supplied in parallel to the peripheral radiation elements 15*b*-15*i*. Meanwhile, in the case where two or more central radiation elements are used, as in a 4×4 array, power is supplied from the first branch line 13 in parallel. According to this power supply method, the power of the central radiation element 15*a* is enhanced and the power of the peripheral radiation elements 15*b*-15*i* is weakened. As a result, the F/B and F/S ratios of the antenna can be improved.

Figure 3:
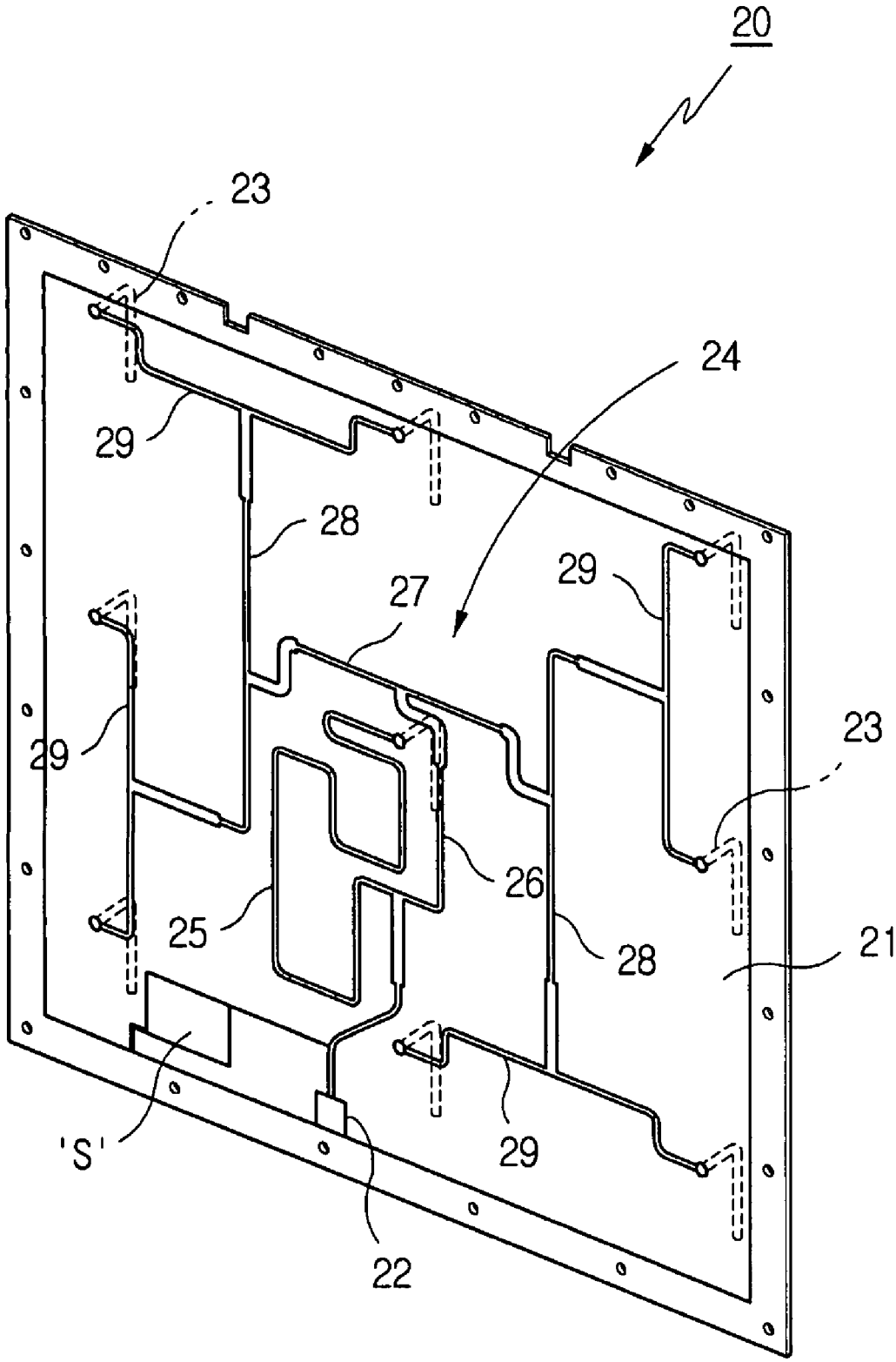
FIG. 3 is a perspective view of a power divider according to the present invention.

FIG. 3 is an example of a divider to which the above-described power division method is applied. A divider 20 includes a dielectric feeding substrate 21 on which a feeding unit 22 and a feeding line 24 are formed, and feed lines 23 which are secured onto the substrate 21 and supply power to respective radiation elements (reference numerals 15*a*-15*i* of FIG. 1) constituting the array antenna. The feed lines 23 are inserted into and secured onto the ends of the feeding line 24. The feed lines 23 can be inserted into and firmly secured onto the substrate 21.

The feeding line 24 is branched from the feeding unit 22 into two branch lines at the first stage of division, and the first branch line 25 of the two branch lines extends in series to the central end of the substrate 21, and the second branch line 26 is branched again and connected in parallel to the peripheral ends of the substrate 21. According to the above-described structure of the divider 20, the power of the central end of the substrate 21 is enhanced and the power of the peripheral ends of the substrate 21 is weakened. In order to make the phases of respective radiation elements (reference numerals 15*a*-15*i* of FIG. 1) uniform, the first branch line 25 is configured in a meandering form.

In order to divide power between respective peripheral ends of the feeding substrate 21, the second branch line 26 is designed to extend to respective peripheral ends via continuous secondary branch lines 27, 28 and 29 in the present embodiment. However, the present invention is not limited to a specific design for the second branch line 26, and various variations of the design can be made. In the drawing, the reference numeral 'S' designates a Direct Current (DC) short circuit that functions to protect the antenna from lightening or some other excessive load.

Meanwhile, power applied to the feeding unit 22 is divided into two parts at the first stage of the feeding line 24. One of the two parts is supplied to the central radiation element 15*a* via the central end of the substrate 21 and the feed line 23, and the other is supplied to the peripheral radiation elements 15*b*-15*i* via respective peripheral ends of the substrate 21 and the feed line 23. According to this structure, the power of the central radiation element 15*a* is enhanced and the power of the peripheral radiation elements 15*b*-15*i* is weakened. Accordingly, the F/B ratio and side lobe characteristic of the antenna can be improved.

Figure 4:
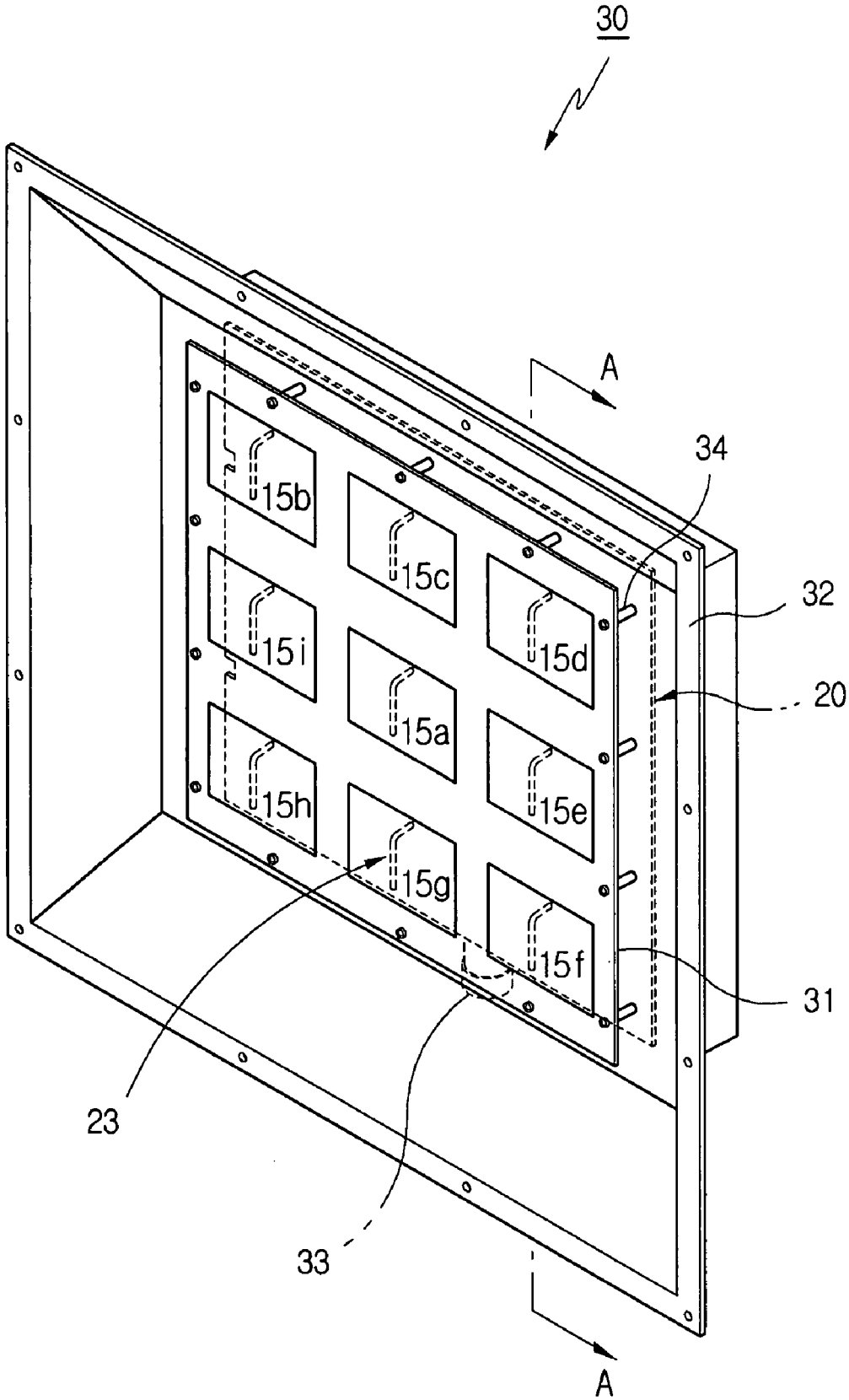
FIG. 4 is a perspective view of an antenna device to which the power divider of FIG. 3 is applied.
Figure 5:
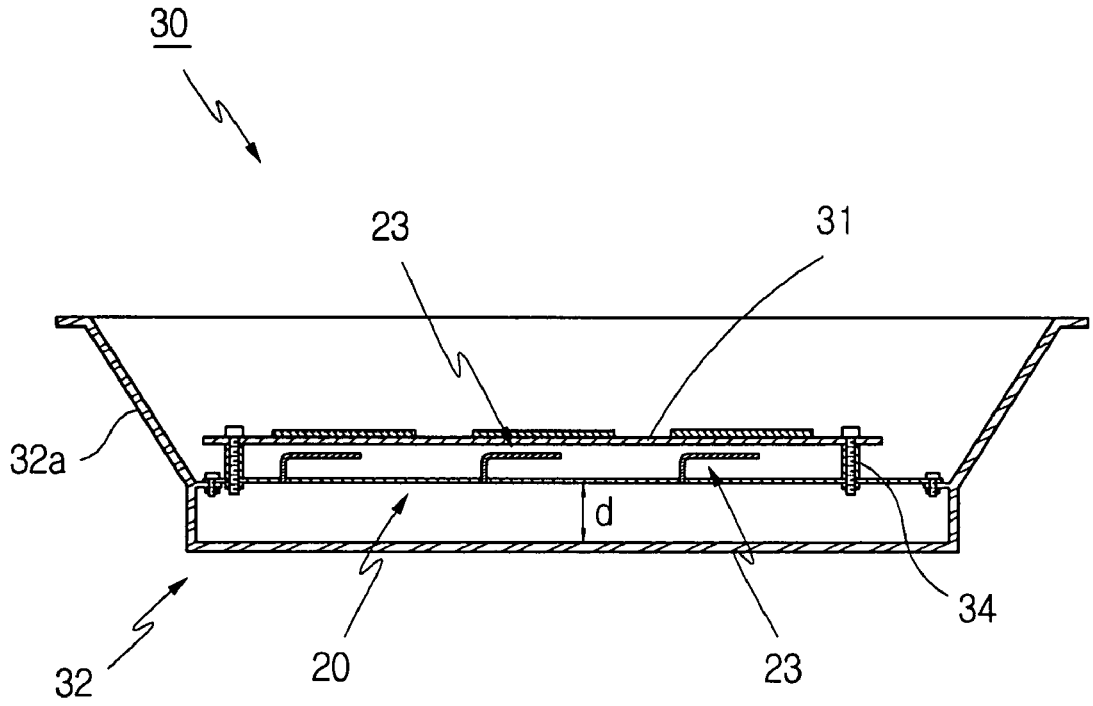
FIG. 5 is a sectional view taken along line A-A of FIG. 4.
Figure 6:
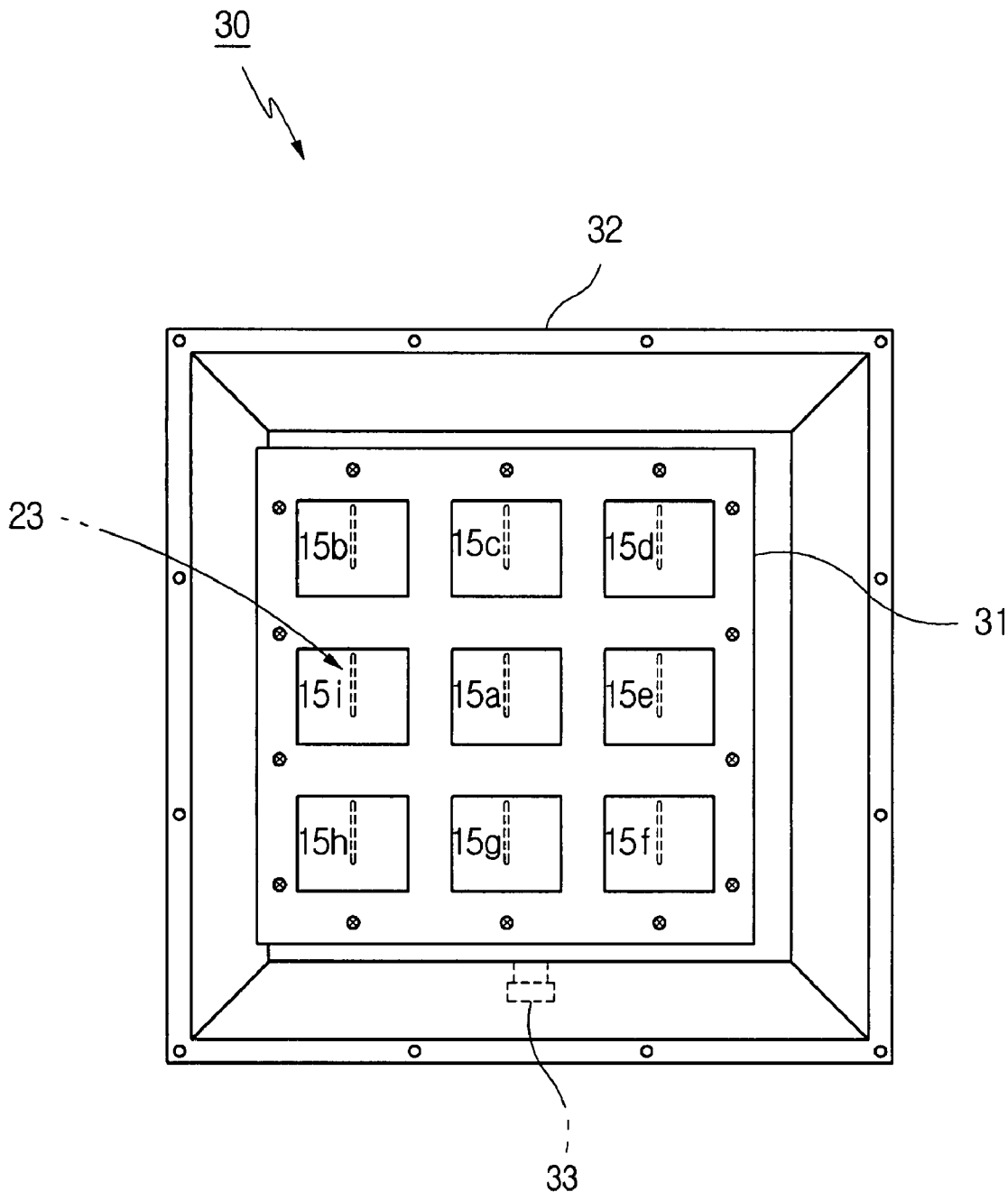
FIG. 6 is a plan view of FIG. 4.

FIGS. 4 to 6 show an antenna device 30 to which the divider 20 is applied. The antenna device 30 includes an array substrate 31, a divider 20 provided behind the substrate 31, and a reflector 32 disposed behind the divider 20 and uniformly spaced apart from the divider 20. In the drawing, reference numeral 33 designates a feed connector.

The divider 20 includes a feeding substrate 21 on which a feeding line 24 is formed, and feed lines 23 which are secured on the feeding substrate 21. In detail, the first ends of the feed lines 23 are vertically secured to respective ends of the feeding line 24, and the feed lines 23 are 'L'-shaped feed lines that are bent parallel to the array substrate 31. The feed lines 23 do not come into direct contact with the array substrate 31, and are coupled to respective radiation elements 15*a*~15*i*, disposed on the array substrate 11, in an Electro-Magnetic (EM) manner. As a result, the feed lines 23 form first radiation units in the antenna device 30, and the radiation elements 15*a*~15*i* form second radiation units on the array substrate 31.

From FIGS. 5 and 6, it can be seen that the array substrate 31 is not located above the center portion of the reflector 32, but is offset from the reflector 32. This results from the shape of the feed lines 23. According to the actual measurement for the asymmetric shape of the 'L'-shaped feed lines 23, a phenomenon in which a side lobe beam pattern was generated in a specific 90° direction occurred. Accordingly, the array substrate 31 is disposed to be offset to one side, as shown in the drawing, so that a side lobe phenomenon attributable to the asymmetry of the feed lines 23 can be eliminated. In this case, the extent of the offset of the array substrate 31 may be adjusted based on the results of actual measurement.

The reflector 32 is one in number. The central portion of the reflector 32 is spaced apart backward from the feeding substrate 21 of the divider 20 by a distance 'd', and the skirt portion 32*a* of the reflector 32 is outwardly inclined. In this structure, the reflector 32 functions to minimize the leakage of radiation power of the feel line 23 as a first radiation unit and to efficiently combine a side lobe with a main beam. From a structural aspect, the divider 20 is placed and secured over the central portion of the reflector 32, and the array substrate 31 is secured over the feeding substrate 21 at a uniform interval using spacers 34 that extend between the feeding substrate 21 and the array substrate 31.

Figure 7A:
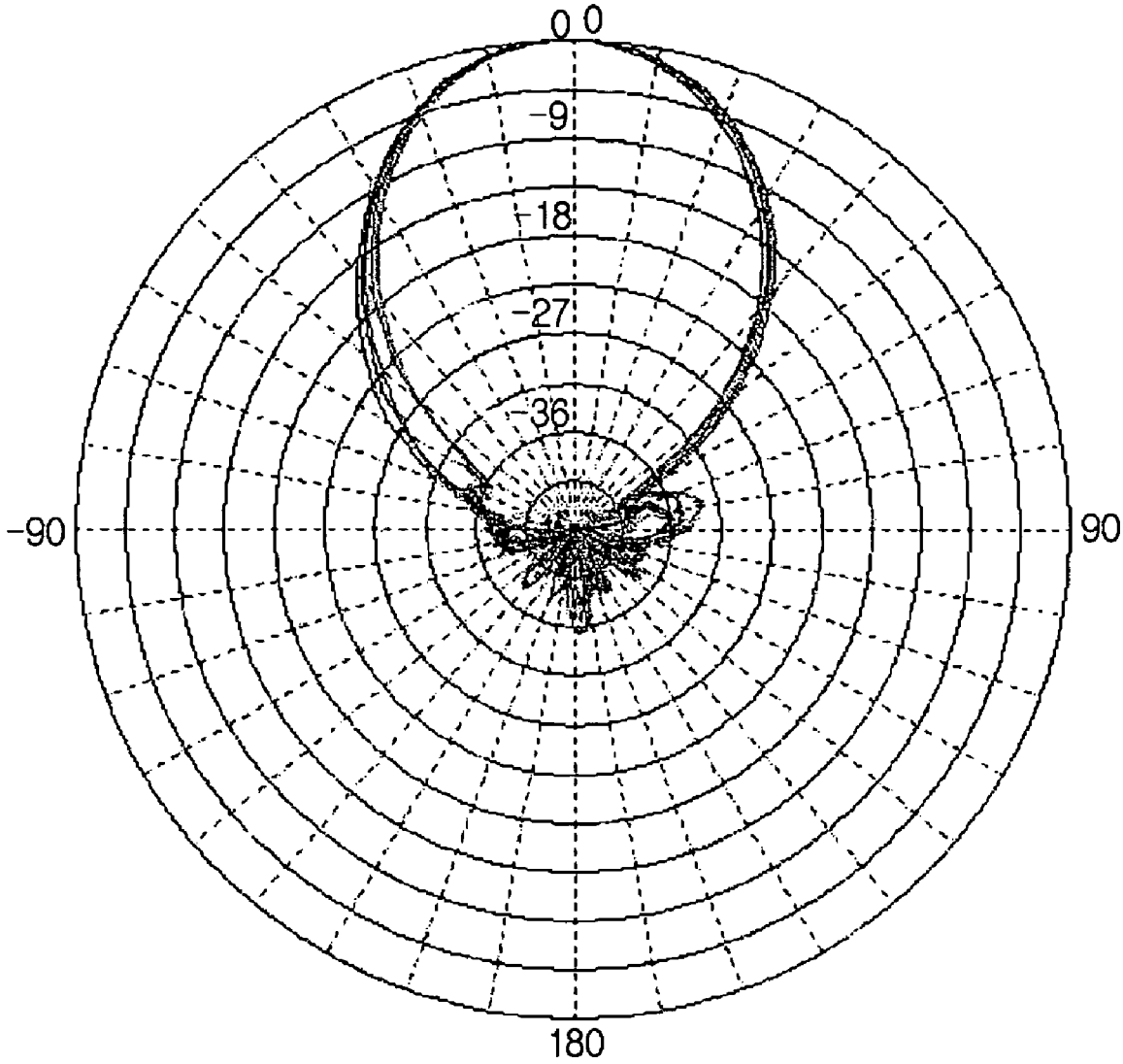
FIG. 7A is a diagram showing the vertical pattern of the antenna device shown in FIG. 4.
Figure 7B:
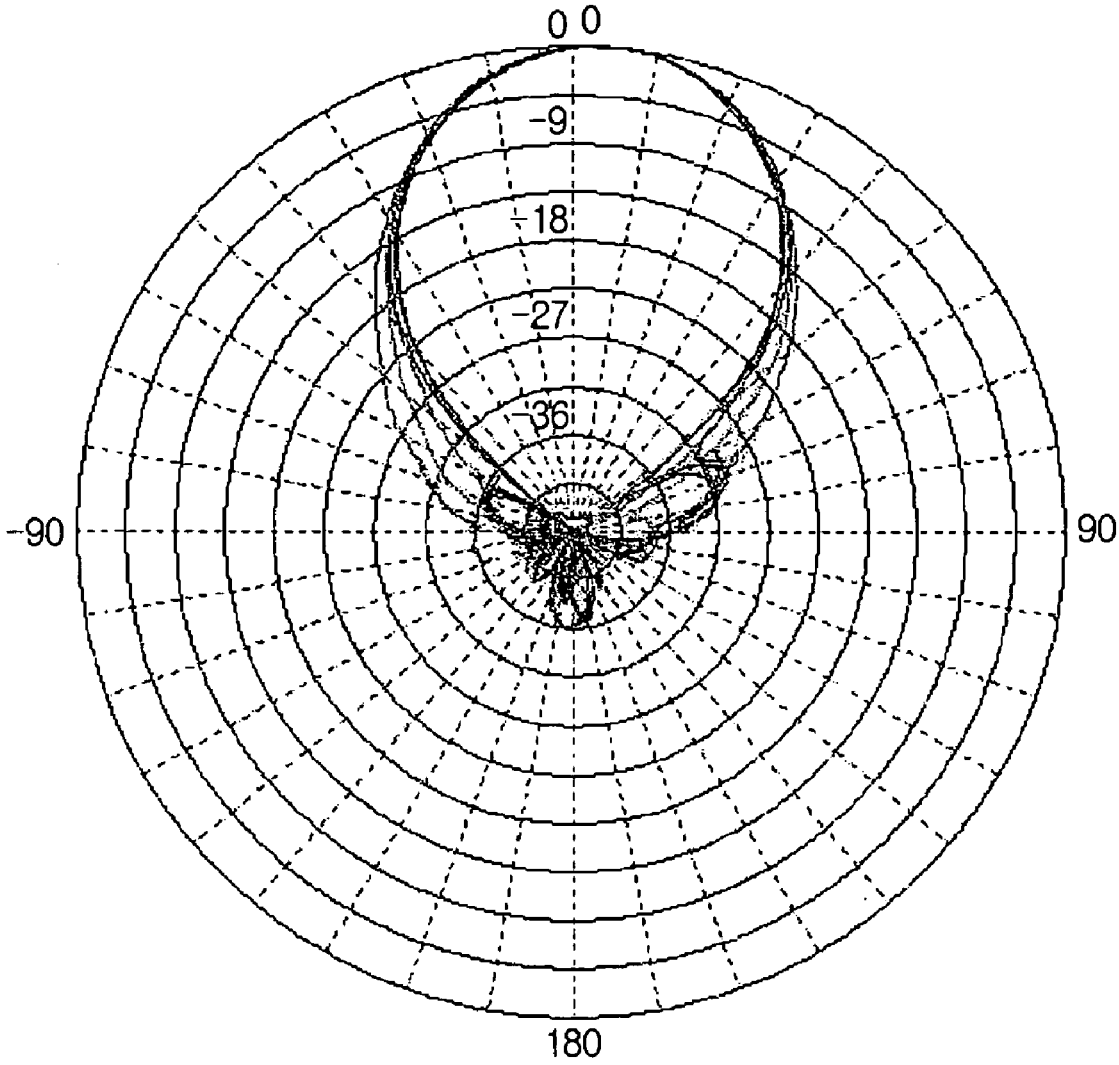
FIG. 7B is a diagram showing the horizontal pattern of the antenna device shown in FIG. 4.
Figure 7C:
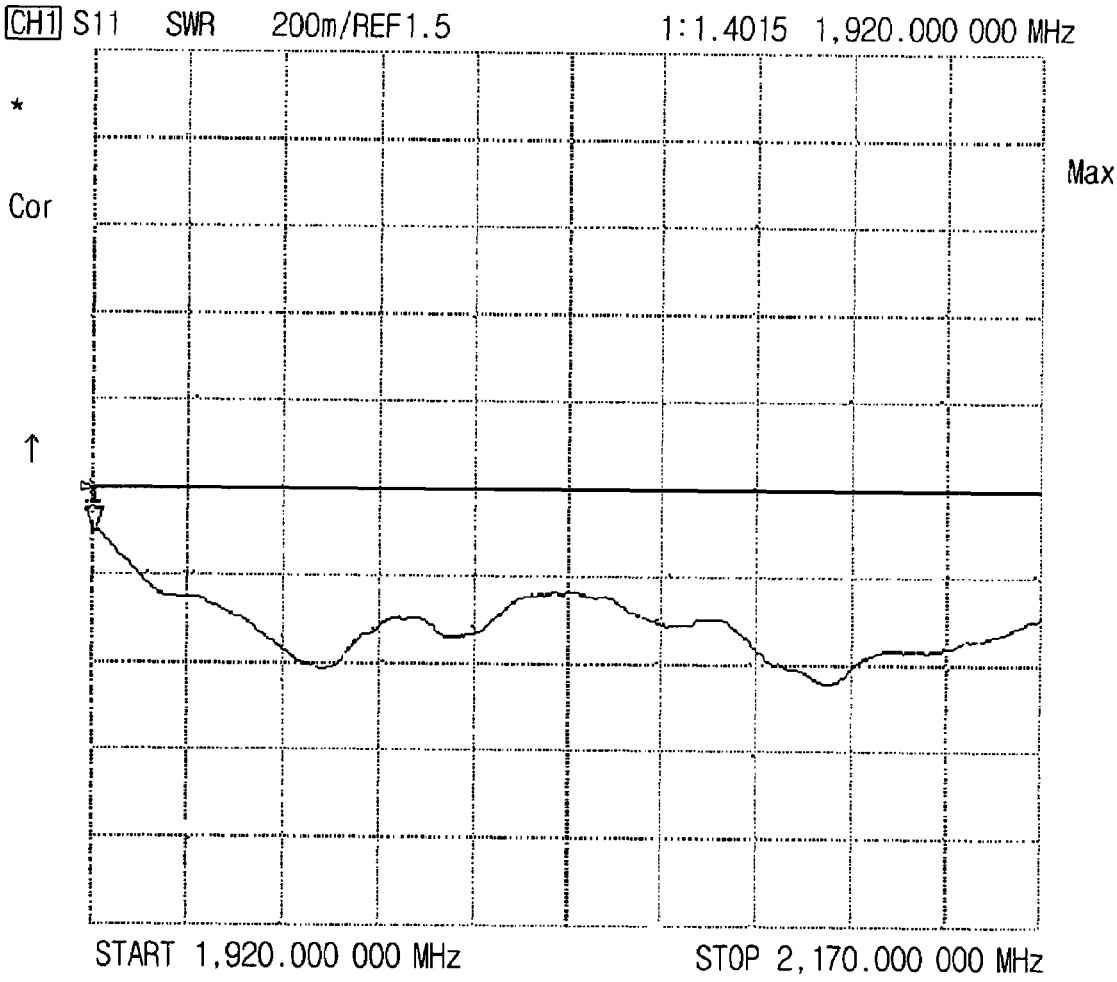
FIG. 7C is a diagram showing the standing wave ratios of the antenna device shown in FIG. 4.

FIGS. 7A, 7B and 7C are graphs showing the vertical pattern, horizontal pattern and standing wave ratio of an antenna device that is configured to have the following dimensions: an area of 410 mm×420 mm and a width of 100 mm. As seen from the graphs, the antenna device exhibited superior characteristics, including an F/B ratio and an F/S ratio greater than 35 dB, and could achieve a desirable standing wave ratio.

The present invention provides the method and divider for dividing power, applied to the feeding unit, into two equal parts, supplying one of the two parts in series to the central radiation element, and supplying the other in parallel to the peripheral radiation elements. The present invention is advantageous in that it can be easily implemented, and the characteristics of an antenna can be improved by applying the present invention to the antenna device.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A power divider for an array antenna, comprising:

a feeding substrate provided with a feeding unit for applying power and a feeding line extending from the feeding unit for dividing power;

feed lines secured on the substrate while in contact with respective ends of the feeding line, and configured to extend at first ends thereof to respective radiation elements constituting the array antenna;

wherein the feeding line is branched into first and second branch lines from the feeding unit at a first stage of division, and the first branch line extends to a central end of the substrate and the second branch line is branched again and extends to peripheral ends of the substrate; and wherein the first branch line is configured in a meandering form.

2. An antenna device, comprising:

an array substrate provided with radiation elements, a divider disposed behind the array substrate, and a reflector spaced apart backward from the divider;

wherein the divider includes a feeding substrate provided with a feeding unit for applying power and a feeding line extending from the feeding unit for dividing power, and feed lines secured on the substrate while in contact with respective ends of the feeding line and configured to extend at first ends thereof to the respective radiation elements constituting an array antenna;

wherein the feeding line is branched into first and second branch lines from the feeding unit at a first stage of division, and the first branch line extends to a central end of the substrate and the second branch line is branched again and extends to peripheral ends of the substrate; and wherein the divider is placed and secured over a central portion of the reflector, and the array substrate is secured over the feeding substrate at a uniform interval using spacers that extend between the feeding substrate and the array substrate.

* * * * *